United States Patent [19]
Meyer
[11] 4,415,061
[45] Nov. 15, 1983

[54] PORTABLE TREE CLIMBING DEVICE

[75] Inventor: Leonard S. Meyer, Columbia, S.C.
[73] Assignee: Victor United, Inc., Chicago, Ill.

[21] Appl. No.: 413,760
[22] Filed: Sep. 1, 1982
[51] Int. Cl.[3] ..... A63B 27/00; A63B 29/04
[52] U.S. Cl. ..... 182/92; 248/544
[58] Field of Search ..... 182/92, 90, 91, 228, 182/82; 248/544, 546

[56] References Cited

U.S. PATENT DOCUMENTS

| | | | |
|---|---|---|---|
| 1,588,566 | 6/1926 | Wismer | 182/92 |
| 3,298,459 | 1/1967 | Bergsten | 182/92 |
| 3,380,697 | 4/1968 | Melcher | 182/92 |
| 3,498,409 | 3/1970 | Meyer | 182/92 |

*Primary Examiner*—Reinaldo P. Machado
*Attorney, Agent, or Firm*—Emory L. Groff, Jr.

[57] ABSTRACT

A portable step assembly for attachment to a tree or pole includes a generally L-shaped climbing member and a separate, headed fastener member. The fastener member is removably insertable through a mounting portion on the climbing member after which the climbing member is employed as a crank tool to drive the fastener member into the tree. A specially configured socket recess or cavity within the mounting portion captively receives the screw member head and serves two primary purposes. First, it allows a one-handed push upon the assembly during the initial drive of the fastener member and secondly, dual sets of shoulders within the socket cavity form positive abutments to screw or unscrew the assembly respectively during its attachment or removal from a tree. By forming an end of the climbing member with a drive head mating with a segment of the mounting portion, the drive head of one climbing member may be coupled with the mounting portion of another climbing member being attached or removed from a tree, so as to provide additional leverage to facilitate application or removal of the fastener.

12 Claims, 9 Drawing Figures

PORTABLE TREE CLIMBING DEVICE

This invention relates generally, to a mechanism enabling the climbing of trees, poles or the like and more particularly, to a portable assembly, a plurality of which are adapted to be successively installed as a user progressively climbs a tree or pole.

Numerous devices have heretofore been proposed to enable one to progressively ascend a wooden upright member such as a tree by means of successively implanted step members. Such devices are intended primarily to serve for a one-time use and being of a temporary nature, are preferably readily removable. In this respect, it will be appreciated that the present invention is particularly desirable for hunters seeking to take up a tree stand or other temporary uses such as a tree surgeon in need of reaching a lofty point in a tree in order to prune branches inaccessible from the ground.

An example of an earlier tree climbing assembly will be found in my prior U.S. Pat. No. 3,498,409 issued Mar. 3, 1970, and which discloses a generally L-shaped climbing member adapted to be secured relative a tree or pole by means of a threaded fastener member provided with an angular head. Driving of the fastener into a tree in this earlier device was accomplished with the assistance of a notch formed in the climbing member such that the climbing member may be used as a crank to engage the head of the fastener within its notch to maintain engagement between the two components during driving or removal of the threaded member relative a tree.

The present invention seeks to offer several advantages over the known prior art devices by providing a crank member having a mounting portion at one end containing a socket or recess adapted to receive and captively retain the polygonal head of a threaded fastener. This socket contains a plurality of angularly offset radial shouldered cut-outs or cavities such that when an angular fastener head is disposed within the socket and then arcuately displaced with respect thereto, the head of the fastener is immobilized or captively retained in both axial directions within the climbing member mounting portion. With this arrangement, it will be appreciated that a user grasping the assembly of the two components in the area of the mounting portion may easily urge the point of the fastener into the periphery of the tree or pole and then by applying pressure with the one hand easily pushes the climbing member mounting portion toward the tree, which pressure or force is directly transmitted to the head of the fastener and therethrough to its point. At the same time, the climbing member is employed as a crank device and rotated about the longitudinal axis of the mounting portion to drive the threaded member into the tree until the mounting portion abuts the outer periphery thereof.

The advantage of the above one-handed operation should not be minimized as it will be understood that portable tree climbing devices are often employed under less than desirable conditions. The weather is often quite fierce and the user may be wearing gloves. Additionally, the climber usually is in a precarious or at least awkward position half-way up the three thus, requiring one arm and hand at all times for grasping the tree for support and balance. Accordingly, the ability to provide for a portable tree climbing assembly possessing the one-handed drive feature of this invention cannot be overlooked.

Other features are included in the present assembly which is preferably constructed as a cast member including an upright crank arm from which extends in an offset manner a step arm. The latter includes a top wall comprising a planar step platform having opposite edges each of which is provided with a plurality of serrations or grooves to improve traction with a user's shoe or boot. Additionally, the lower end of the climbing member is provided with a generally triangularly configured formation terminating in a relatively sharp lowermost point by which the user may readily form a starting hole in the periphery of the tree or pole. With this starting point lcoated at the lowermost extremity of the climbing member, it is well removed from an area which would be engaged by a user's footwear or pant leg during descent from a tree equipped with the present climbing assembly.

An additional feature includes the formation of the end of the step arm in the configuration of a polygonal tool head mating with an opening in the mounting portion of each climbing member so that a second climbing member may be used to provide added leverage in applying or removing a first climbing member and fastener.

Accordingly, one of the objects of the present invention is to provide an improved portable tree climbing assembly comprising a unitary crank arm and step arm member having a socket at one end adapted to receive and captively retain the angular head of a removable fastener such that axial displacement between the fastener and climbing member is precluded following angular displacement of the fastener head within the socket.

Another object of the present invention is to provide an improved portable tree climbing assembly including a climbing member having an upright crank arm from which extends an offset step arm provided with a serrated planar top wall and wherein a sharpened point is formed at the lowermost extremity of the climbing member.

Still another object is to provide an improved portable tree climbing assembly including a climbing member releasably attachable by means of a removable threaded fastener having an angular head with the fastener insertable through only one side of the climbing member into the confines of a socket having a plurality of symmetrically disposed, segmented radial cut-outs.

A further object is to provide a tree climbing assembly including a climbing member having a drive tool portion engageable with a mounting portion of any other similar climbing members to provide increased leverage in applying or removing any one such member from a tree.

With these and other objects in view which will more readily appear as the nature of the invention is better understood, the invention consists of the novel construction, combination and arrangement of parts hereinafter more fully described, illustrated and claimed.

Similar reference characters designate corresponding parts throughout the several figures of the drawing.

Figure 1:
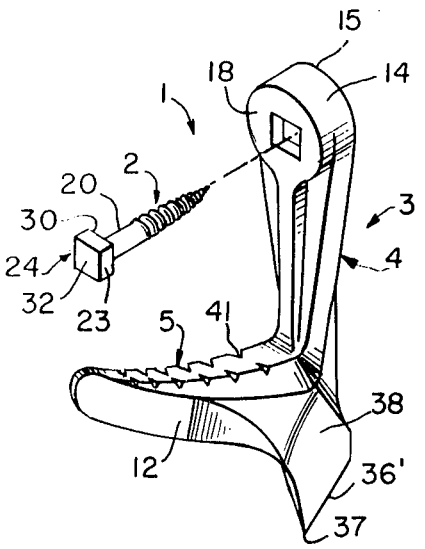
FIG. 1 is a top perspective view showing the components of the invention.

Referring now to the drawing, particularly FIG. 1, the climbing assembly of the present invention is generally designated 1 and will be seen to comprise a removable fastener member 2 and a climbing member 3. This climbing member is preferably an integral device readily lending itself to formation by casting. Included is an upright crank arm 4 joined to an offset or outwardly extending step arm 5. Strength is obtained while minimizing the amount of material required by forming the crank arm 4 with opposite outer and inner ribs 6 and 7 bounded by the two laterally projecting side flanges 8—8. As shown most clearly in FIGS. 1, 2 and 4, these side flanges 8 of the crank arm 4 continue from their lowermost point as the two side walls 9—9 of the step arm 5 and project outwardly and slightly upwardly toward the end 10 of the step arm. The side walls 9 combine with a substantially planar top wall or step platform 11 to provide the actual surfaces engaged by the bottom of a climber's shoe or boot. The platform 11 is supported by means of a bottom web 12 extending from the step arm end 10 to the lower end 13 of the climbing member. A raised nose 10', as most evident in FIG. 4, serves as a stop to discourage slipping of a user's footwear off the end of the platform 11.

A mounting portion, generally designated 14, is provided adjacent the upper end 15 of the climbing member and serves as the area of the device which provides direct fixation to the outer periphery of a tree or pole 16. As shown most clearly in FIG. 4 of the drawing, the crank arm 4 includes an inner face 17 adapted to be retained juxtaposed the tree and an accessible opposite outer face 18. An axial opening is presented throughout the thickness of the mounting portion 14 and the configuration of this opening will be seen to vary along different axial points therethrough. Immediately adjacent the inner face 17, this opening comprises a cylindrical bore 19, the diameter of which is only slightly larger than that of the shank 20 of the fastener member 2. Adjacent the opposite or outer face 18 of the crank member 3 there is provided a polygonal bore 21 having its center axially aligned with that of the oppositely disposed cylindrical bore 19. The flat surfaces 22 of each side of the bore or passageway 21 will be understood to be configured to provide a close sliding fit with the corresponding number of flat surfaces 23 of the head 24 of the removable fastener 2. A square head 24 is shown in the drawing but it will be understood that alternate angular configurations may be utilized. In any case, the lateral extent of the head configuration will exceed that of the bore 19 to preclude passage of the fastener head through the bore 19.

Within the confines of the mounting portion 14, intermediate the passageway 21 and bore 19, is a drive socket or recess 25, lateral portions of which radially extend a greater distance than axially adjacent portions of the passageway 21 and cylindrical bore 19.

Figure 3:
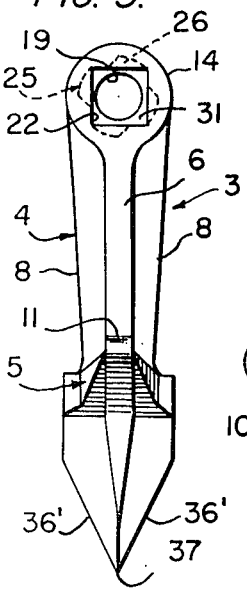
FIG. 3 is an end elevation of the climbing member.
Figure 4:
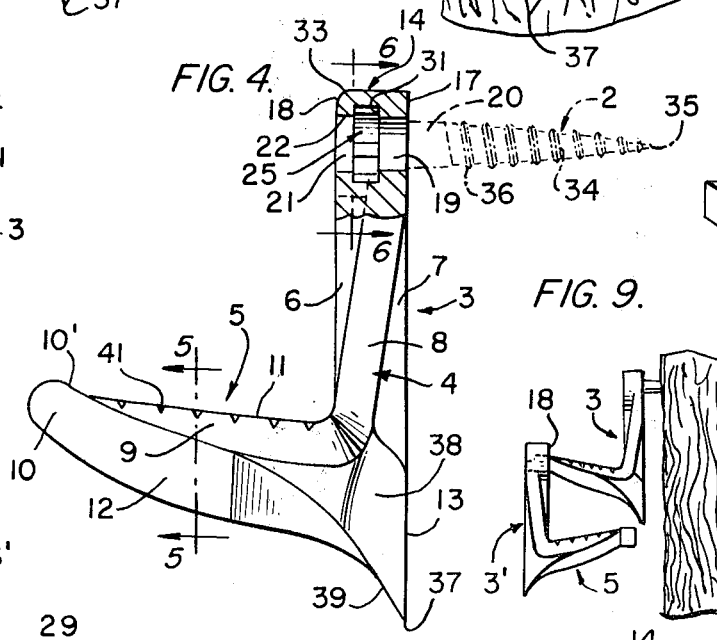
FIG. 4 is a side elevation of the climbing assembly with the mounting portion of the climbing member shown in section.
Figure 6:
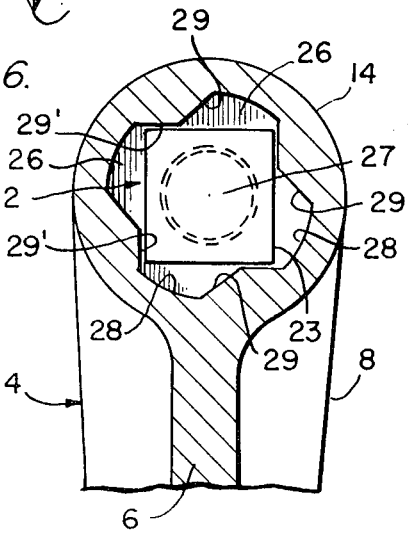
FIG. 6 is an enlarged partial section view taken along the line 6—6 of FIG. 4 and illustrates the head of the fastener aligned with a similarly configured passageway in one face of the climbing member.
Figure 5:
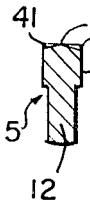
FIG. 5 is a vertical sectional view taken along the line 5—5 of FIG. 4.
Figure 7:
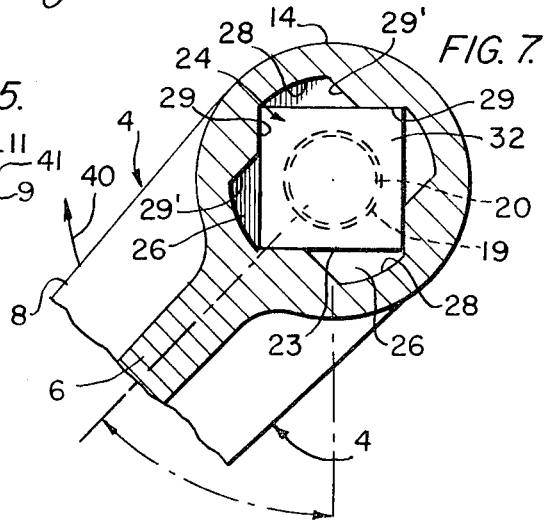
FIG. 7 is a view similar to FIG. 6 and illustrates the climbing member when arcuately displaced relative the fastener member head and as the components appear during driving of the fastener member into a tree or pole.

The construction of the socket 25 and its relationship to the remainder of the mounting portion 14 will be further clarified upon a review of FIGS. 3, 6 and 7 of the drawing. The socket 25 includes a plurality of radial shouldered cut-outs 26, corresponding in number to the flat surfaces 23 provided on the polygonal or angular head 24 of the fastener 2 and these cut-outs will be seen to be symmetrically arranged about the common center axis 27 extending through the passageway 21, socket 25 and bore 19. The cut-outs 26, preferably numbering the same as the number of fastener head surfaces 23, each comprises an arcuate peripheral wall 28 bounded by two opposite straight abutment walls or shoulders 29—29'. The axial extent of the cavity or socket 25 will be understood to be no less than the axial dimension of the fastener head 24 so that when the fastener is combined with the climbing member 3 as shown in FIG. 4 of the drawing, the undersurface 30 of the fastener head engages the bottom wall 31 of the socket 25 while the top 32 of the fastener head will be juxtaposed the top wall 33 of the socket formation. The angular disposition of the flat shoulders will be determined by the number of head surfaces 23 as will become obvious hereinafter.

Turning to the construction of the fastener member 2 itself, this component of the invention preferably comprises a lag screw with a substantially long tapered threaded portion 34 terminating in a very sharp point 35. The diameter of the thread crest 36 is no greater than the diameter of the shank 20 to insure an interference-free relationship when the threaded portion 34 is initially inserted through the mounting portion 14 from the outer face 18 thereof. During this assembly of the two components of the invention, the fastener 2 is axially inserted through the mounting portion 14 until its shank 20 is closely fitted within the cylindrical bore 19 and the fastener head 24 is fully confined within the mounting portion socket 25 as shown in FIG. 4 of the drawing. This assembly is only possible by angularly positioning the fastener head 24 until it is oriented with the substantially congruent close fitting configuration of the polygonal passageway 21.

When the fastener is then fully seated with its head disposed within the socket of the climbing member mounting portion 14, the fastener and climbing member are angularly displaced with respect to one another from the position of FIG. 6 to that of FIG. 7. This displacement will be seen to produce an engagement of alternate ones of the shoulders 29 with adjacent ones of the flat surfaces 23 of the fastener head and most importantly, this relative displacement shifts the fastener head out of registry or orientation with the passageway 21 of the climbing member mounting portion 14. In this manner, portions of the fastener head top wall 32 are now axially disposed in a sandwiched manner beneath the socket top wall 33 and bottom 31. With this arrangement, it will be understood that the fastener head will now be captively retained against axial displacement relative the climbing member 3 so that a pushing or pulling force applied to the climbing member against the outer face or inner face thereof is transmitted as a direct and equal pushing or pulling force along the longitudinal axis of the fastener member 2.

With an appreciation of the above described structure, the manner of attaching or removing the climbing assembly of this invention can now be related. Depending upon the surface and hardness of the particular tree or pole 16 involved, it usually will be desirable to provide a starter hole (not shown) in the peripheral surface of the tree and the climbing member 3 itself can be employed from this purpose. As will be seen most clearly from FIGS. 3 and 4, the inner face 17 of the climbing member, in the area of the lower end 13, includes a pair of lateral edges 36'—36' which are tapered inwardly to a point 37. Extending from these lateral edges to the bottom web 12 of the step arm 5 are a pair of tapered lateral surfaces 38—38 which intersect in the area of the starting point 37 to form a crest 39. The configuration of these lateral edges 36' and lateral surfaces 38 is such that the two lateral edges 36 are disposed to form an acute angle with one another while the above described crest 39 forms an acute angle with the climbing member inner face 17. The convergence of these surfaces and edges thus forms a starting point 37 which is quite sharp and can be used to provide a starting hole in the tree 16 by using the member 3 as a twisting awl. Then, the climbing assembly 1, with its components in the position as shown in FIG. 7, can be urged toward the tree with the fastener member point 35 being pushed into the starting hole by the application of one-handed pressure upon the mounting portion 14 of the climbing member 3. Completion of the attachment of the climbing member is obtained by utilizing the climbing member itself as a tool for rotating and thus driving the threaded fastener member into the tree. This action involves rotating the crank arm 4 of the climbing member in the direction of the arrow 40 of FIG. 7 which produces a direct arcuate driving force upon the threaded member in view of the engagement between the shoulders 29 and flat surfaces 23 of the fastener 2.

Figure 2:
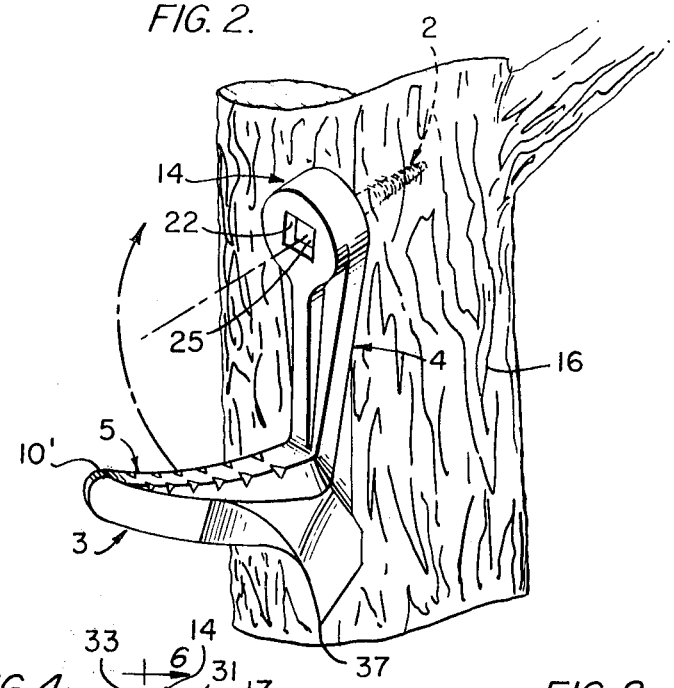
FIG. 2 is a view similar to FIG. 1 and shows the assembly mounted upon a tree.

When fully installed, the climbing assembly will appear as shown in FIG. 2 wherein the inner face 17 of the climbing member 3 is substantially flushly disposed against the periphery of the tree 16 and in this use position, it will be seen that the starting point 37 is fully removed from the area of the step arm platform 11 and the mounting portion 14 to minimize the likelihood of engagement of the starting point by the user's footwear or clothing during climbing or descending of the tree by means of the present invention.

When the user descends the tree or pole and wishes to remove the climbing assemblies 1, the above described procedure is merely reversed. The step arm 5 serves as a handle to manipulate the crank arm 4 in a counter-clockwise direction opposite that of the arrow 40 of FIG. 7 until the other set of cut-out shoulders 29' are engaged by the respective flat surfaces 23 of the fastener head 24 and the arcuate displacement of the climbing member is continued until the threaded portion 34 of the fastener is removed from the tree or pole. Thereafter, the two components of the climbing assembly 1 may be separated by merely rotating the fastener member with respect to the climbing member until its head 24 registers with the substantially congruent configuration of the polygonal passageway 21 so that the fastener member may be removed through the outer face 18 of the climbing member.

To increase friction between the user's footwear and the step arm 5, a plurality of notches or serrations 41 are formed in the platform 11 and extend through each intersecting side wall 9.

Figure 8:
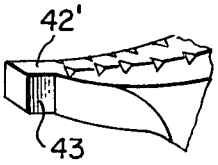
FIG. 8 is a partial end perspective view of a modified step arm end.
Figure 9:
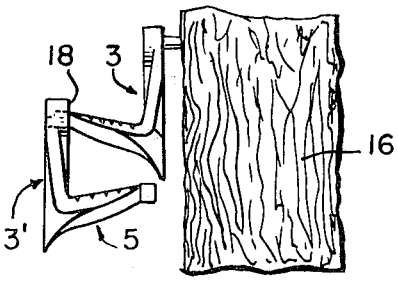
FIG. 9 is a side elevation illustrating the use of the embodiment of FIG. 8.

Even when employing the improved construction of the above described climbing assembly, there may occur instances when the user finds it extremely difficult to apply or remove the fastener member 2 for example, when encountering a hardwood tree. By modifying the end 10 of the step arm 5 as shown in FIG. 8, any additional or second climbing member 3' may be coupled with another or first climbing member being installed or removed, so as to provide added leverage facilitating the driving or removing of the fastener member 2 in the manner as illustrated in FIG. 9 of the drawings. The step arm end is provided with a polygonal drive or tool head 42 having flat surfaces 43 configured to closely mate within the flat surface 22 of the mounting portion passageway 21. With the resultant coupling as shown in FIG. 9, the outer face 18 of the additional member 3' will be facing the tree 16 so that the step arm 5 of the member 3' is in the same vertical plane as the step arm 5 of the member 3. This keeps the crank arm moment as close to the tree as possible for maximum effectiveness of the added leverage.

I claim:

1. A portable step unit for climbing a tree or the like comprising, an angular climbing member provided with an upright crank arm and an offset step arm, said crank arm including opposite inner and outer faces and having a lower end from which said step arm projects, a mounting portion adjacent an opposite upper end of said crank arm and having a socket therein intermediate said inner and outer faces, said socket configured to accept a fastener member angular head therein, said mounting head including a bore communicating with said socket and inner face and adapted to pass a fastener member threaded portion therethrough, said mounting head having a passageway communicating with said socket and outer face, said passageway having a radial periphery configured to allow axial passage of a fastener member angular head therethrough into said socket while precluding angular displacement of said head within sad passageway, and captivating means in said socket precluding axial displacement of said fastener member head toward said outer face when said head is arcuately shifted within said socket.

2. A portable step unit according to claim 1 wherein, said socket includes separate drive means alternatively engageable with flat side surfaces of a fastener member head to alternately rotate the fastener member in a clockwise and counter-clockwise direction respectively as said climbing member crank arm is angularly displaced.

3. A portable step unit according to claim 1 wherein, said captivating means includes a plurality of radial cut-outs in said socket and at least a portion of said cut-outs having a radial extent greater than that of said passageway.

4. A portable step unit according to claim 1 wherein, said step arm includes a top step platform and a bottom web projecting beneath said platform.

5. A portable step unit according to claim 1 wherein, said crank arm lower end includes two inclined lateral edges intersecting at the lower extremity of said climbing member to form a point.

6. A portable step unit according to claim 1 wherein, said mounting head bore is cylindrical and includes a diameter substantially less than the lateral extent of said passageway.

7. A portable step unit according to claim 1 wherein, said climbing member comprises a unitary cast device.

8. A portable step unit according to claim 2 wherein, said drive means includes arcuately spaced apart pairs of shoulders whereby, one of each of said pairs of shoulders is engaged by a fastener member head as said crank arm is angularly displaced in a selected direction.

9. A portable step unit according to claim 3 wherein, said cut-outs are symmetrically arranged and equal in number to the number of side surfaces of the fastener member head adapted to be inserted within said socket.

10. A portable step unit according to claim 4 including, a raised nose at the free end of said step arm projecting above the plane of said platform.

11. A portable step unit according to claim 1 wherein, said climbing member includes a polygonal tool head insertable within and mating with said passageway periphery of another identical climbing member.

12. A portable step unit according to claim 11 wherein, said tool head is one said step arm.

* * * * *